US006779493B2

(12) United States Patent
Doherty et al.

(10) Patent No.: US 6,779,493 B2
(45) Date of Patent: Aug. 24, 2004

(54) COMBUSTION MECHANISM FOR GENERATING A FLAME JET

(75) Inventors: James E. Doherty, Barrington, IL (US); Joseph E. Fabin, Elmwood Park, IL (US); Larry M. Moeller, Mundelein, IL (US); James W. Robinson, Mundelein, IL (US); Christian Paul Andre Ricordi, Bourg-les-Valence (FR); Richard Urban, Prospect Heights, IL (US); Donald L. Van Erden, Wildwood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 124 days.

(21) Appl. No.: 10/170,736

(22) Filed: Jun. 13, 2002

(65) Prior Publication Data

US 2003/0230255 A1 Dec. 18, 2003

(51) Int. Cl.[7] ..... B25C 1/08
(52) U.S. Cl. ..... 123/24 A; 227/10
(58) Field of Search ..... 123/262, 263, 123/268, 280, 285, 286, 24 R, 24 A; 227/10; 60/39.6

(56) References Cited

U.S. PATENT DOCUMENTS

| | | | | | |
|---|---|---|---|---|---|
| 3,042,008 | A | * | 7/1962 | Liessie | 227/10 |
| 3,967,771 | A | * | 7/1976 | Smith | 227/10 |
| 4,365,471 | A | | 12/1982 | Adams | |
| 4,403,722 | A | | 9/1983 | Nikolich | |
| 4,483,474 | A | * | 11/1984 | Nikolich | 227/10 |
| 4,510,748 | A | | 4/1985 | Adams | |
| 4,665,868 | A | | 5/1987 | Adams | |
| RE32,452 | E | * | 7/1987 | Nikolich | 123/46 SC |
| 4,759,318 | A | | 7/1988 | Adams | |
| 4,773,581 | A | | 9/1988 | Ohtsu et al. | |
| 5,197,646 | A | * | 3/1993 | Nikolich | 227/10 |
| 5,687,898 | A | * | 11/1997 | Toulouse | 227/10 |
| 5,713,313 | A | * | 2/1998 | Berry | 123/46 SC |
| 6,378,288 | B1 | | 4/2002 | Towfighi et al. | |
| 6,619,527 | B1 | * | 9/2003 | Moeller | 227/10 |
| 2001/0006044 | A1 | | 7/2001 | Hasler et al. | |
| 2001/0006045 | A1 | | 7/2001 | Thieleke et al. | |
| 2001/0006046 | A1 | | 7/2001 | Thieleke et al. | |
| 2002/0020374 | A1 | | 2/2002 | Buchel et al. | |
| 2003/0222114 | A1 | * | 12/2003 | Nishikawa et al. | 227/10 |

FOREIGN PATENT DOCUMENTS

| | | |
|---|---|---|
| DE | 199 50 342 | 10/1999 |
| DE | 199 50 352 | 10/1999 |
| DE | 199 62 695 | 12/1999 |
| DE | 199 62 711 | 12/1999 |
| DE | 199 62 584 | 6/2001 |
| DE | 199 62 697 | 6/2001 |

* cited by examiner

*Primary Examiner*—Erick Solis
(74) *Attorney, Agent, or Firm*—Lisa M. Soltis; Mark W. Croll; Donald J. Breh

(57) ABSTRACT

A mechanism for generating a flame jet has a volume formed of at least one vertical structure and two opposing horizontal structures. A rotatable fan is located within the volume, and is rotatable in a plane generally parallel to the planes of the horizontal structures. The mechanism also contains means for igniting a combustible gas which is contained within the volume, to propel a flame jet outside of the volume.

23 Claims, 13 Drawing Sheets

COMBUSTION MECHANISM FOR GENERATING A FLAME JET

BACKGROUND OF THE INVENTION

The present invention relates to a mechanism for generating a flame jet, and more specifically to a two-volume combustion apparatus in which a flame jet is generated and transmitted from one volume into the other, particularly in conjunction with combustion-powered fastener driving tools.

Gas combustion devices are known in the art. A practical application of this technology is found in combustion-powered fastener driving tools. One type of such tools, also known as IMPULSE□ brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722, 5,197,646 and 5,263,439, all of which are incorporated by reference herein. Similar combustion powered nail and staple driving tools are available commercially from ITW-Paslode of Vernon Hills, Ill. under the IMPULSE□ brand.

Such tools incorporate a generally pistol-shaped tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel metering valve to introduce a specified volume of fuel into the closed combustion chamber.

Upon the pulling of a trigger switch, which causes the spark to ignite a charge of gas in the combustion chamber of the engine, the piston and driver blade are shot downward to impact a positioned fastener and drive it into the workpiece. The piston then returns to its original, or "ready" position, through differential gas pressures within the cylinder. Fasteners are fed magazine-style into the nosepiece, where they are held in a properly positioned orientation for receiving the impact of the driver blade.

Upon ignition of the combustible fuel/air mixture, the combustion in the chamber causes the acceleration of the piston/driver blade assembly and the penetration of the fastener into the workpiece if the fastener is present. Combustion pressure in the chamber is an important consideration because it affects the amount of force with which the piston may drive the fastener. Another important consideration the amount of time required to drive the piston and complete the ancillary processes between combustion cycles of the engine. A typical operator of a combustion-powered tool will generally sense a delay when the time required to drive the fastener after pulling the trigger is more than approximately 35–50 milliseconds. There are other types of conventional combustion-powered tools which do not incorporate a fan in the combustion chamber.

Single-chamber combustion systems are effective in achieving a fast combustion cycle time. This type of system, however, does not generally realize peak combustion pressures to drive a piston which are as high as those seen in other gas combustion-powered tools.

One such conventional combustion-powered tool which yields decent peak combustion pressures is a two-chamber system, where at least one of the chambers has a tubular shape and is connected to the second chamber. The tubular shaped first chamber has a tube length L and a diameter D, and the ratio of L/D is known to be high, that is, between two and twenty, and preferably ten. A spark plug is located at one closed end of the first chamber, and the other end of this tubular chamber is in communication with the second chamber via a port. The port connecting the two chambers typically includes a reed valve, which remains normally closed to prevent back flow of pressure from the second chamber into the first tubular chamber.

The first tubular chamber, having a volume V1, operates as a compressor. A fuel/air mixture in V1 is ignited by the spark plug at the closed end of the tubular chamber, and advances a flame front toward the port end of the tube. As the flame front advances, unburned fuel/air ahead of the flame front is pushed into the second chamber, or volume V2, and thereby compresses the fuel/air mixture in V2. As the flame propagates from V1 through the port and reed valve and into V2, the air/fuel mixture in V2 ignites. The ignited gas in V2 thus rapidly builds pressure in V2 and closes the reed valve to prevent loss of pressure back into V1. The greater the compression in V2, the greater will be the final combustion pressure of the system, which is desirable. Longer tubular chambers are thus generally preferred as V1 because longer tubes are known to create greater pre-compression into V2.

Long V1 tubes however, result in longer times between the spark at the closed end of V1 and the ignition of the air/fuel mixture in V2, which is undesirable. In a piston driving tool system, longer V2 ignition time also creates a need for a piston delay mechanism, such that the piston movement will begin immediately prior to where the pressure in V2 builds to a maximum obtainable pressure. A typical two-chamber system can take 35 milliseconds to reach peak pressure in V2 to drive a piston (not including time to complete the ancillary processes), which is about the amount of time where the tool operator will generally sense a delay in the tool's operation.

Time required to complete the ancillary processes for these two-chamber system tools will add to the noticeable delay experienced by the tool operator. The ancillary process time is also known to be greater for two-chamber systems than in single-chamber systems. The time to complete the ancillary processes becomes even greater as the length of the tubular first chamber V1 increases.

A third known gas combustion system utilizes an "accelerator plate" placed in a single tubular volume, to effectively divide the volume in two. The accelerator plate itself includes multiple holes for communication between the two volumes, and fuel distribution is provided to both volumes separately through a common fuel supply line with two orifices. An operator of a device employing this system triggers fuel mixing via three-inch actuation. This type of device has been shown to allow repeatable combustion cycling. A drawback to accelerator plate systems, however, is that they tend to be bulky and cumbersome to operate. Also, a volume on one side of the accelerator plate may not be increased without necessarily decreasing the other volume.

SUMMARY OF THE INVENTION

The above-listed concerns are addressed by the present mechanism for generating a flame jet, which features solid chamber structure containing a combustible gas. An ignition device ignites the combustible gas at one end of the chamber, creating a flame front which rapidly travels through the chamber to be propelled out the chamber at the opposite end as a flame jet. A fan in the chamber acts to mix the gas in the chamber, as well as create a turbulence which enables the flame front to move more rapidly across the chamber.

More specifically, the present invention provides a mechanism for generating a flame jet which has a volume formed of at least one vertical structure and two opposing horizontal structures. A rotatable fan is located within the volume, and is rotatable in a plane generally parallel to the planes of the horizontal structures. The mechanism also contains an ignition source to ignite a combustible gas contained within the volume, the mechanism being configured for propelling a flame jet outside of the volume.

In another preferred embodiment, the mechanism of the present invention may also serve as the combustion chamber of a two-chamber combustion powered apparatus. The flame jet generated by the mechanism is propelled into a second chamber, which is in communication with the combustion chamber. Pressure generated within the second chamber may then drive a piston device connected to the second chamber.

In a two-chamber system, this mechanism is effective for generating rapid combustion cycles and high pressures in a separate chamber. The mechanism is particularly useful for generating, in a relatively compact geometry, rapid combustions and high pressures that are typically seen in larger and more cumbersome devices.

DETAILED DESCRIPTION OF THE INVENTION

Figure 1:
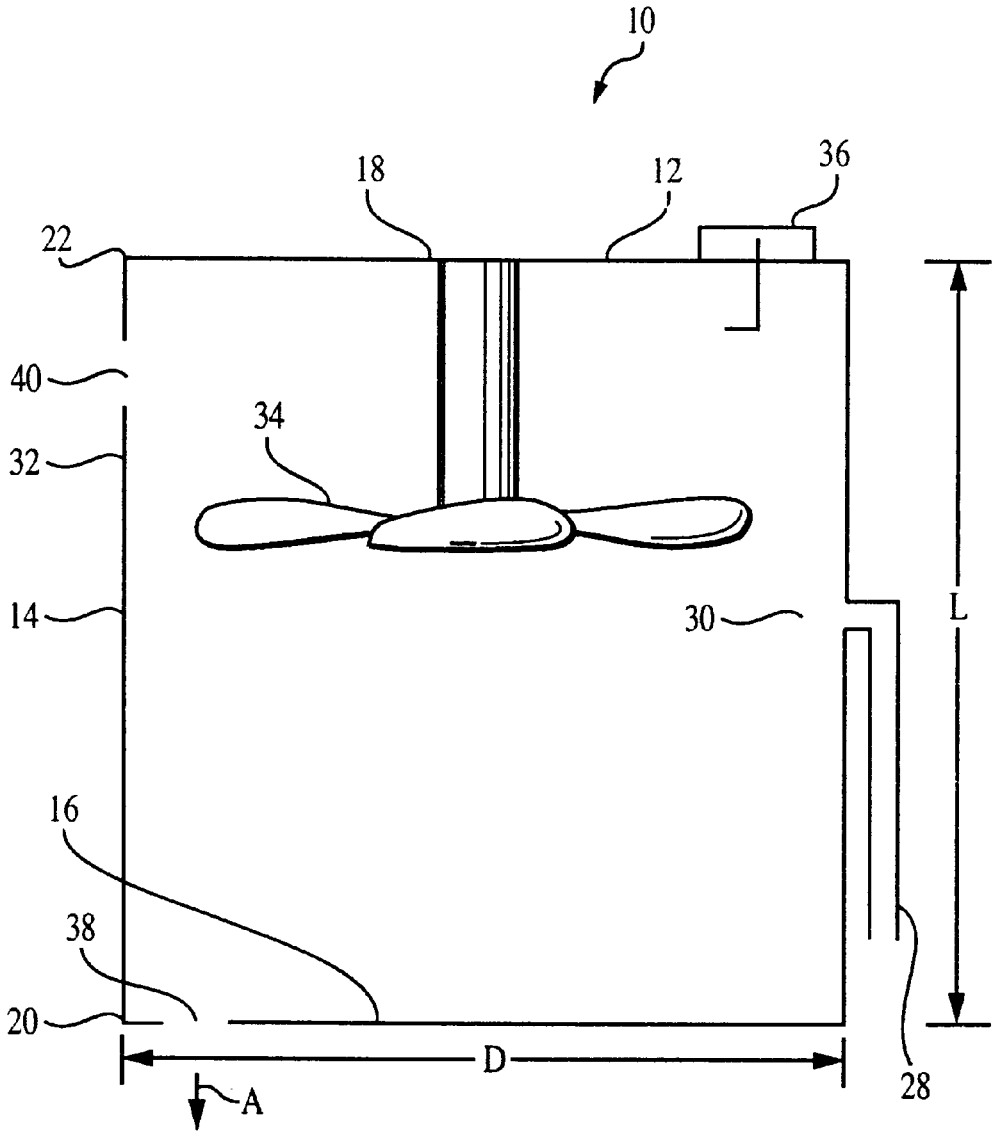
FIG. 1 is a vertical schematic sectional view of the preferred embodiment of the present mechanism.
Figure 2:
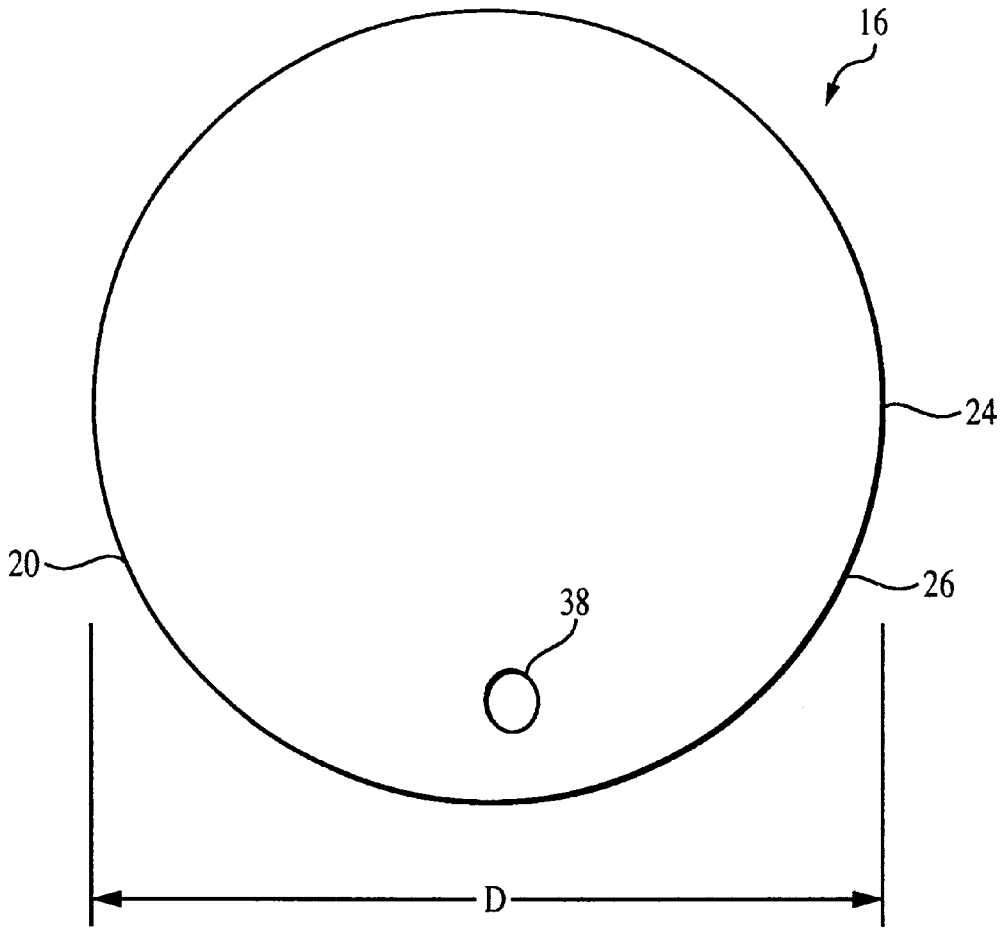
FIG. 2 is an overhead plan view of the horizontal structure feature of the present invention.

Referring now to FIGS. 1–2, a high-energy flame generating mechanism is generally designated 10, and includes a combustion chamber body 12 enclosing a volume which is defined by vertical structure 14 and two opposing horizontal structures 16 and 18. The structures 14, 16, 18 are preferably rigid metal bodies, but may also be formed from other strong, rigid, and combustion-resistant materials known in the art. One end of the vertical structure 14 is fixedly joined to horizontal structure 16 at a joint 20, and the opposite end of the vertical structure 14 is fixedly joined to horizontal structure 18 at joint 22. The joints 20 and 22 preferably represent one continuous structure including structures 14 and 16, but may also be a weld, glue, compressed gasket, or other combustion-resistant joint capable of withstanding repeated pressures.

The vertical structure 14 is preferably configured to form a cylinder or a tube, but may also be formed into any continuous structure, or series of structures, which correspond to outer dimensions of the horizontal structures 16 and 18. Horizontal structure 16 preferably has the shape of a rounded disk 24 with a diameter D and an outer perimeter 26. For example, where the vertical structure 14 is a cylinder, the diameter of the cylinder will match the diameter D of the disk 24.

Figure 1A:
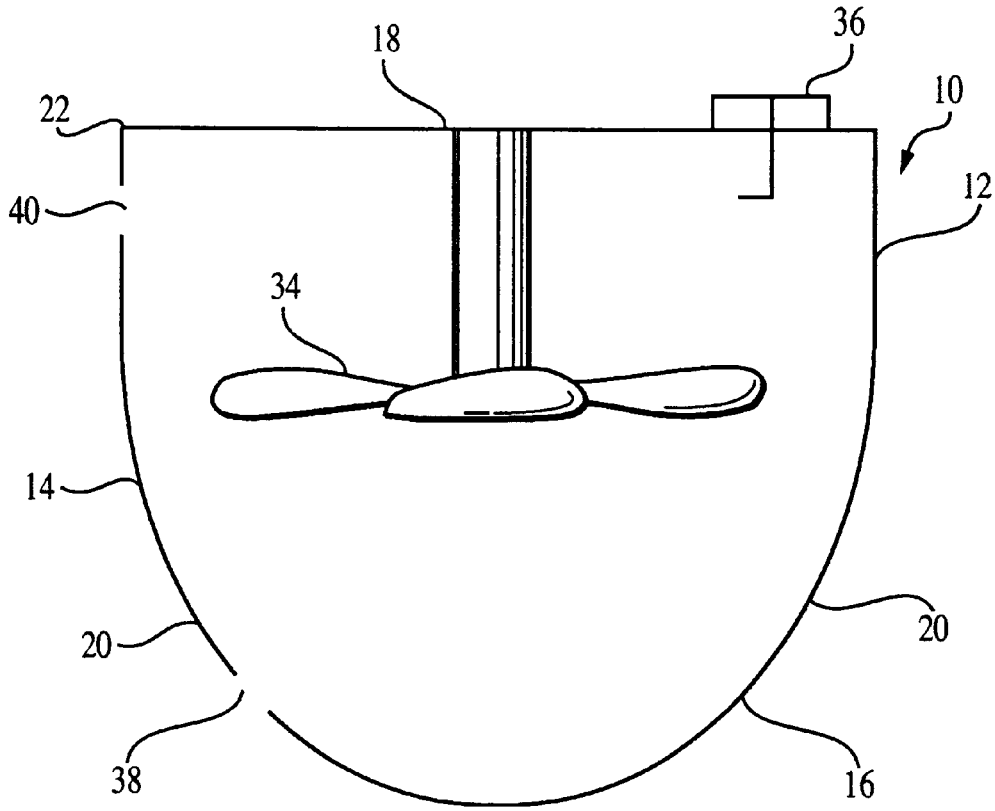
FIG. 1A is a vertical schematic sectional view of another embodiment of the present mechanism.

Although, the cylinder/disk configuration is preferred, vertical structure 14 and horizontal structure 16 need not be at right angles relative to one another, or even be planar structures. Horizontal structure 16 may be bowl-shaped, for example, and have an outer diameter D different from that of horizontal structure 18. In such a case, vertical structure 14 may arced so that a continuous body formed by the vertical structure 14 and the horizontal structure 16 is hemispherical or parabolic in shape, as shown in FIG. 1A. One skilled in the art will be aware that any number of irregular three-dimensional shapes may also be used for vertical structure 14 and horizontal structures 16 and 18 to form a volume for the chamber body 12, without departing from the present invention.

In the preferred embodiment, the joint 20 joins the outer perimeter 26 of the horizontal structure 16 where it contacts the cylinder diameter at one end of the vertical structure 14. In this preferred embodiment, horizontal structure 18 has the same dimensions as horizontal structure 16, and similarly joins a cylinder diameter of the opposite end of the vertical structure 14 at the joint 22. The vertical structure 14 of the cylinder has a length L such that the aspect ratio of L/D is preferably less than 2. Because a compact structure is preferable in tools or systems employing the mechanism 10, an aspect ratio of 1, or ½, is even more desirable.

A combustible fuel is fed into the chamber 12 from a fuel line 28, through a fuel aperture 30, which is located on a wall 32 of the vertical structure 14, and preferably in a low pressure area of the chamber 12 upstream of a fan 34. While one suitable fuel is MAPP gas of the type used in combustion-powered fastener driving tools, the fuel may be any of a number of known combustible fuels practiced in the art. The fuel mixes with air in the chamber 12 to create a combustible gas. The fan 34 is located within the chamber 12 and rotates in a plane generally parallel to a plane defined by either of the horizontal structures 16 or 18. The rotating fan 34 rapidly and evenly mixes the fuel with the air in the chamber 12. An even fuel/air mixture is desirable to provide a consistent and predictable operation of the mechanism 10. The more rapidly an even fuel/air mixture is obtained, the less time is then required between repeated cycles or uses of the mechanism, which is also desirable.

An ignition source 36 for igniting the fuel/air mixture is provided within the chamber 12, and is preferably located on the horizontal structure 18. The ignition source 36 is preferably a spark plug, but may also be any device known in the art for enabling a rapid and controlled ignition of the combustible gas. Upon a signal from an operator, the ignition source 36 generates a spark which ignites the combustible fuel/air mixture in the chamber 12 in the area of the ignition source 36, whereby a flame front is created that travels from the ignition source 36 to the opposite end of the chamber 12. Having a surface area similar to a spherical wave front, the flame front travels outward from the ignition source 36. The time required to ignite the fuel in the chamber 12 is dependent upon the surface area of the flame front. The present inventors have discovered that the turbulence created by the fan 34 significantly increases the surface area of the moving flame front. The greater flame front surface area therefore allows a much faster combustion of the fuel/air mixture in the chamber 12, which is desirable.

The pressure from combustion causes a flame to be propelled out of the chamber 12 through a flame jet port 38 as a high energy flame jet which travels outside of the chamber 12 in the general direction designated A. The flame jet port 38 is preferably located on the horizontal structure 16 at a sufficient distance from the ignition source 36 to enhance the flame acceleration. In one preferred embodiment, the flame jet port 38 is located 270 degrees from the ignition source 36, in a vertical plane where the ignition source 36 is located at 0 degrees.

After combustion, it is desirable to rapidly scavenge/purge the combustion by-products from the chamber 12. The rotating fan 34 also facilitates a more rapid scavenging of the chamber 12. In a preferred embodiment, the scavenging process is further assisted by at least one recirculation port 40, which is preferably located on the vertical structure 14 between the plane of rotation of the fan 34 and the ignition source 36. The recirculation port 40 also assists in fuel mixing—one of the ancillary processes.

Figure 3:
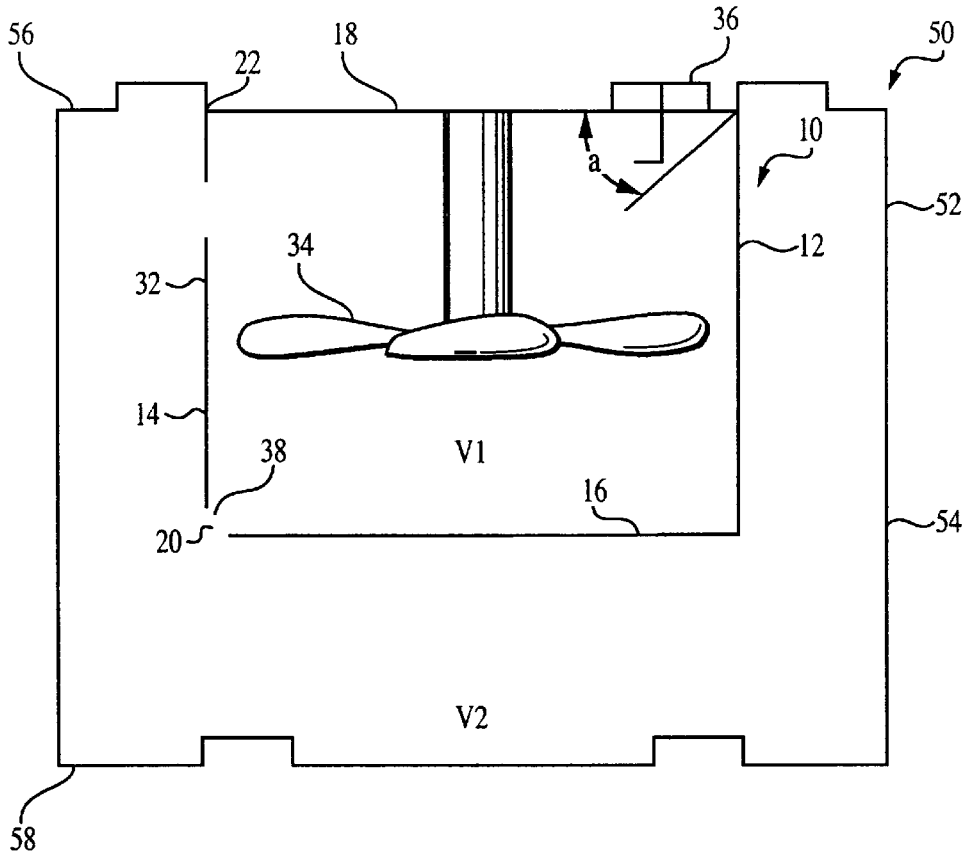
FIG. 3 is a vertical schematic sectional view of a two-chamber system employing the mechanism of the present invention.
Figure 4:
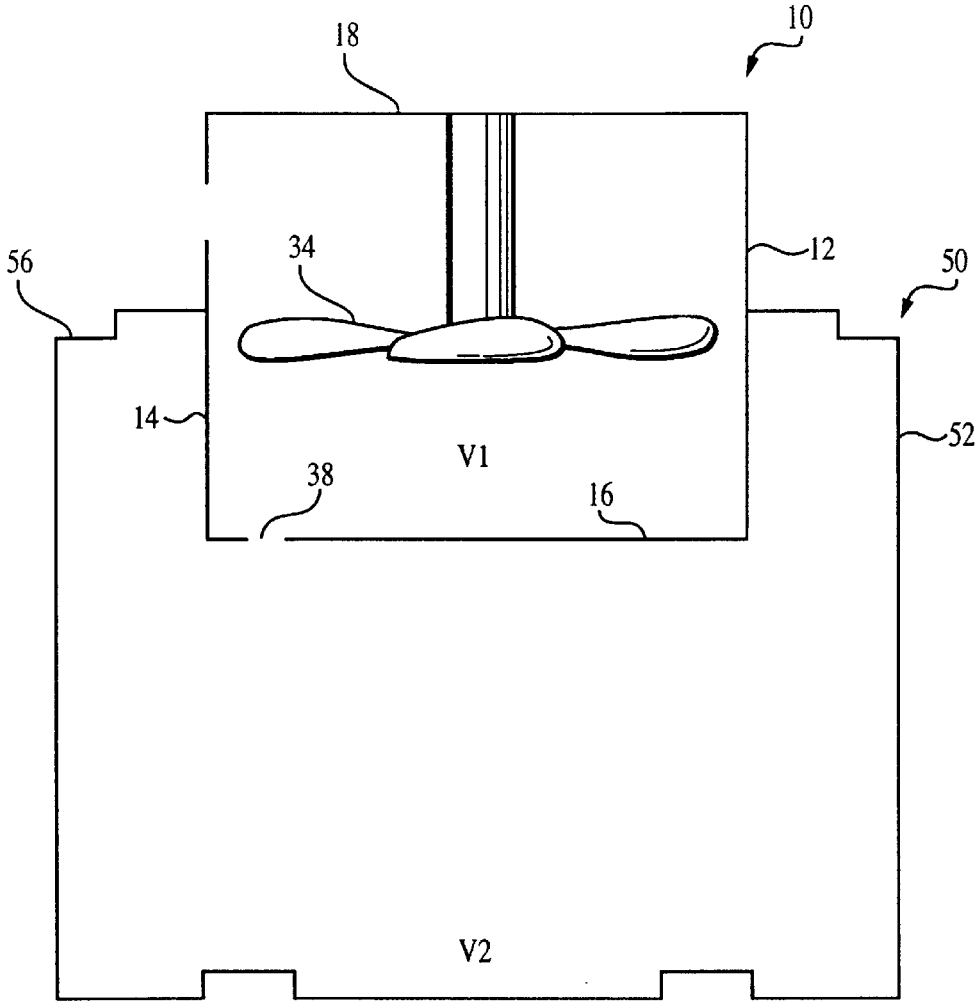
FIG. 4 is a sectional view of another embodiment of the present invention.
Figure 5:
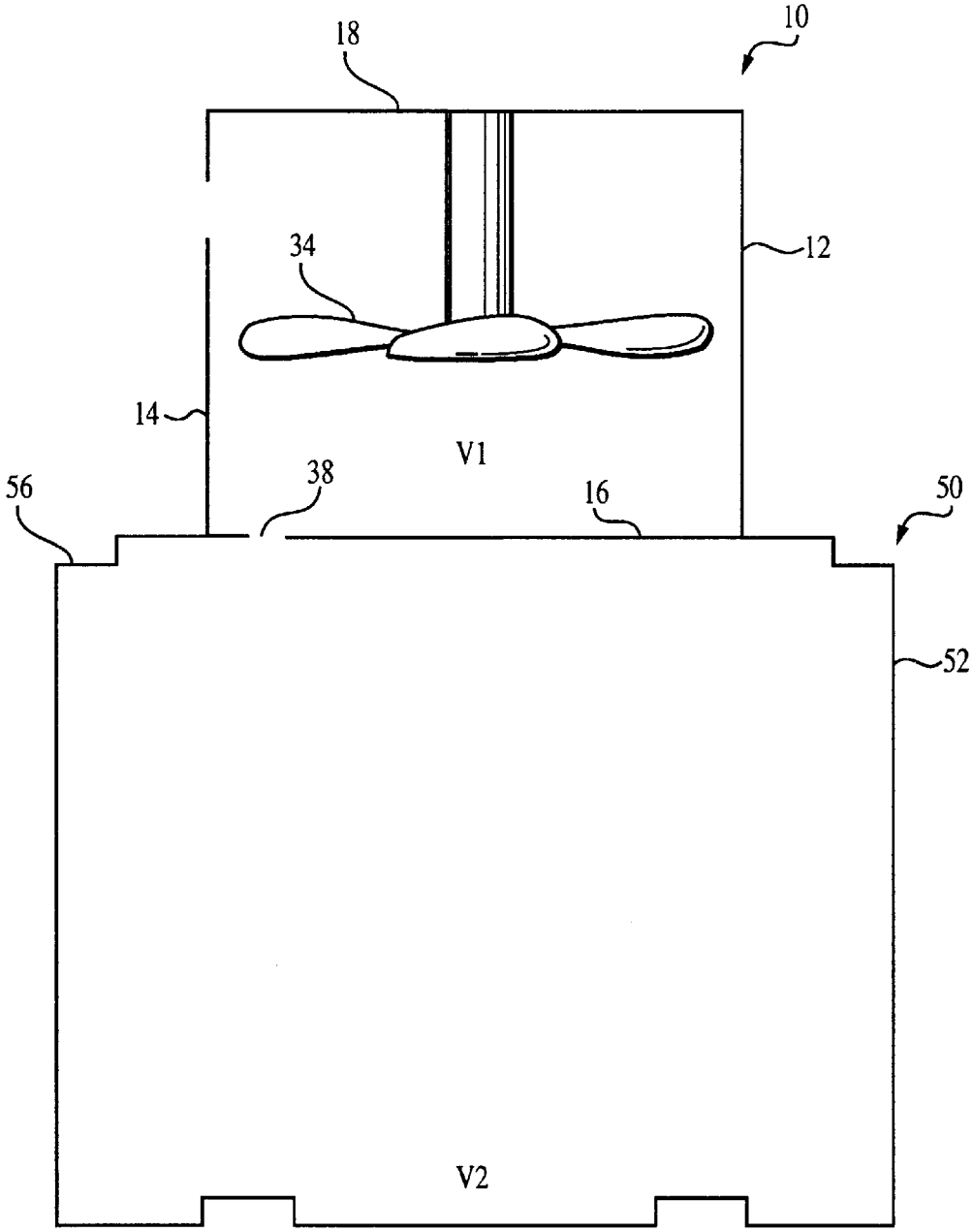
FIG. 5 is a sectional view of a further embodiment of the present invention.

Referring now to FIGS. 3–5, an alternate combustion apparatus is generally designated 50, and incorporates the flame-generating mechanism 10 into a two-chamber configuration. The combustion chamber 12 serves as the first chamber of the apparatus 50. A second chamber 52 is also provided and functions as the other chamber of the two-chamber apparatus 50. In the preferred embodiment, the second chamber 52 has an overall shape geometry similar to that of the combustion chamber 12, and is also formed from the same solid, rigid, and combustion-resistant materials.

The second chamber 52 has a generally vertical wall 54 and two opposing upper and lower horizontal walls 56, 58, whose dimensions, however, do not necessarily correspond to the dimensions of similar structures of the combustion chamber 12. It is contemplated that the precise shape of the wall 54 may vary to suit the particular device or application, and may include round or other non-linear dimensions. It is similarly contemplated that the dimensions of chamber 12 may also be non-linear to suit the particular device or application. The chambers 12 and 52 are configured so that a flame may be produced in combustion chamber 12 and will progressively move into the second chamber 52 as a high-speed jet of flame from the flame jet port 38.

A volume V1 is defined by the combustion chamber 12, and a volume V2 is defined by the second chamber 52. In a preferred embodiment, the combustion chamber 12 is located partially or entirely within second chamber 52. FIG. 4 shows the apparatus 50 with the chamber 12 partially located within the chamber 52. In either configuration, the volume V2 is defined by the entire volume within the dimensions of the second chamber 52, minus any volume occupied by the combustion chamber 12. In this respect, the volume V2 can vary depending on the location of the chamber 12, without any change in the volume V1 or the dimensions of the second chamber 52.

In the preferred embodiment, the second, or upper, horizontal structure 18 of the combustion chamber 12 may even be formed of a portion of the upper horizontal wall 56 of the chamber 52, with the vertical structure 14 and first horizontal structure 16 then forming a cup-shaped divider between the volumes V1 and V2. In an alternate embodiment, as shown in FIG. 5, the first horizontal structure 16 may instead be formed from a portion of the horizontal wall 56. In either embodiment, the chambers 12 and 52 are relatively located so that the volumes V1 and V2 are in communication through the flame jet port 38, and so that the mechanism 10 creates combustion pressures in the volume V2.

The present inventors have discovered that the rotation of the fan 34 introduces a swirl in the combustion chamber 12, and that combustion pressures in the volume V2 improve when the flame jet port 38 is located downstream of the spark from the ignition source 36 in the direction of the swirl. The preferred angle a from the ignition source 36 to the flame jet port 38 varies according to the dimensions of the combustion chamber 12 and the rotation speed of the fan 34. In a preferred embodiment, the flame jet port 38 is located at the joint 20 at a point which maximizes the distance between the flame jet port 38 and the ignition source 36. A design goal is to displace the flame jet port 38 at a distance from the ignition source 36 to allow for maximum acceleration of the flame within the chamber 12, but without greatly increasing time required for the flame to travel from the ignition source 36 to the flame jet port 38. These two factors must be balanced, and carry variable weight depending on the particular configuration or application.

Figure 6:
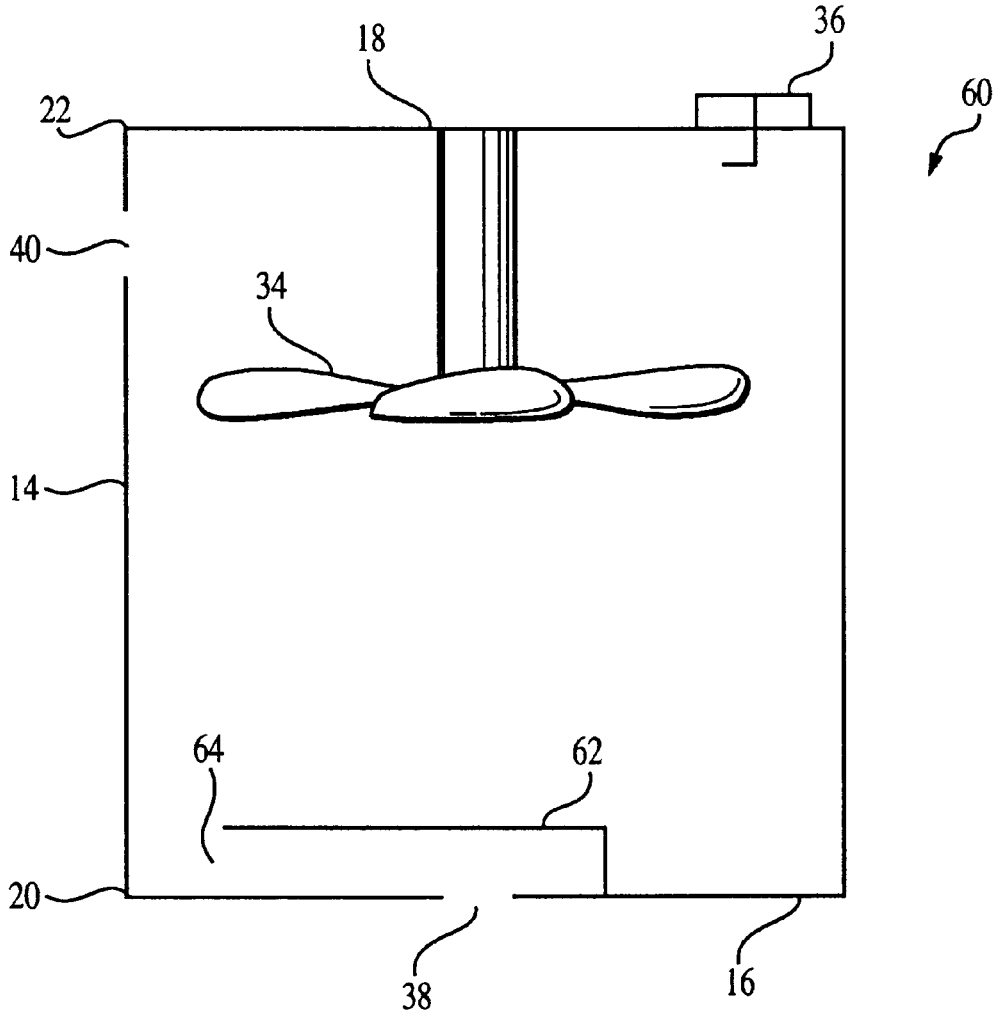
FIG. 6 is a partial sectional view of the combustion chamber of the present invention, illustrating a centrally located flame jet port feature.
Figure 7A:
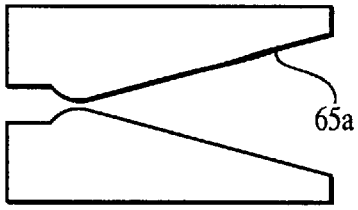
FIGS. 7A–7D are partial schematic sectional views of the supersonic nozzle feature of the present invention.
Figure 7B:
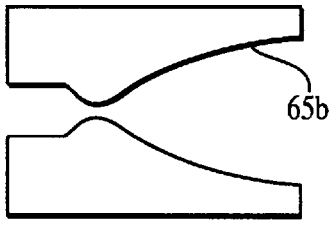
Figure 7C:
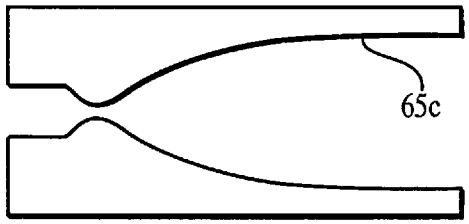
Figure 7D:
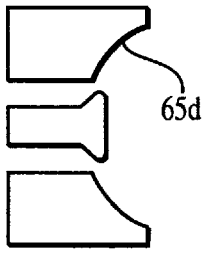

Referring now to FIG. 6, an alternate flame-generating mechanism is generally designated 60. In this embodiment, the flame jet port 38 is centrally located on the first horizontal structure 16. In some embodiments, space considerations make a central port location desirable. However, in some such configurations, sufficient distance is not available within the chamber 12 for the flame jet to travel from the ignition source 36 to achieve maximum flame acceleration. The present inventors have discovered that a shroud 62 may be placed over the flame jet port 38 on the interior of the combustion chamber 12, which effectively creates an additional distance for the flame to travel around the shroud 62. The flame travels into an opening 64 of the shroud 62 which is located at a preferred distance away from the port 38. The shroud 62 may be of any shape which provides a channel that requires the flame to travel a preferred distance. It is also contemplated that a similar shroud structure may be incorporated into mechanisms employing flame jet ports not centrally located, or employing multiple flame jet ports, where a greater flame travel distance is also desirable.

According to the foregoing configurations of the present invention, flame jet speeds of up to and greater than sonic velocity have been realized passing through the flame jet port 38. The flame jet speed is generally temperature-dependent. At flame temperature, for example, the present invention can realize flame jet speeds of up to 1000 meters per second (m/s). The present inventors have measured average flame jet speeds of greater than 300 m/s for the foregoing configurations. This average flame jet speed is approximately 5–10 times or more the speed of the flame jet that would have been expected in conventional two-chamber systems. This improvement is even more noticeable when compared with the average flame speed in the conventional single-chamber with fan system, which average 20–30 m/s.

When the speed of the flame jet through the port 38 reaches the speed of sound, a "choked flow" condition exists in the port 38, which means that the flame jet speed, once "choked," does not increase beyond the sonic speed barrier. Choked flow is a desirable condition to achieve because the present inventors have discovered that this condition creates shock waves and/or standing waves which energize the flame jet as it enters the volume V2 from the port 38. This high-speed, energized flame jet enables a rapid ignition and combustion of the fuel/air mixture in the volume V2. The present inventors have also discovered that the pressure in the volume V2 rapidly begins to increase when the choked flow condition is reached. The time required to achieve choked flow is affected by the combustion time of the volume V1. Choked flow is reached sooner as the volume V1 combustion time decreases.

A choked flow condition in the flame jet port limits the velocity of the flame jet to the speed of sound for normal configurations of the present invention. However, the present inventors have discovered that flame jet velocities into the volume V2 greater than the sonic velocity may be achieved by using super-sonic nozzles in place of the flame jet port 38. As the flame jet velocity in the volume V2 increases beyond the speed of sound, even stronger ignition will be achieved in the volume V2, which will in turn result in more rapid combustion and greater combustion pressure.

Referring now to FIGS. 7A–7D, several supersonic nozzles 65*a–d* are shown having a sectional "converging-diverging" configuration. The supersonic nozzles thus become the communication path of combustion between volumes V1 and V2. The converging/diverging shape of the supersonic nozzles further energizes the flame jet entering the volume V2 and thus increases the bum rate of the air/fuel mixture in the volume V2. Although the converging/diverging design for the supersonic nozzle is preferred, other configurations are contemplated which would also allow passage of a flame jet having a velocity greater than the speed of sound.

The increase of pressure from combustion in the volume V2 can lead to a backflow into the volume V1 through the flame jet port 38 or the recirculation port 40. Reed valves are useful for allowing only unidirectional flow through ports. Reed valves remain normally closed, but open only when pressure on one side of the valve reaches a sufficient threshold. While reed valves are effective for preventing backflow from the volume V2 into the volume V1, because they stay normally closed and only allow flow in one direction, they can be counterproductive to rapid completion of the non-combustion ancillary processes between the higher-pressure combustion events.

Figure 8:
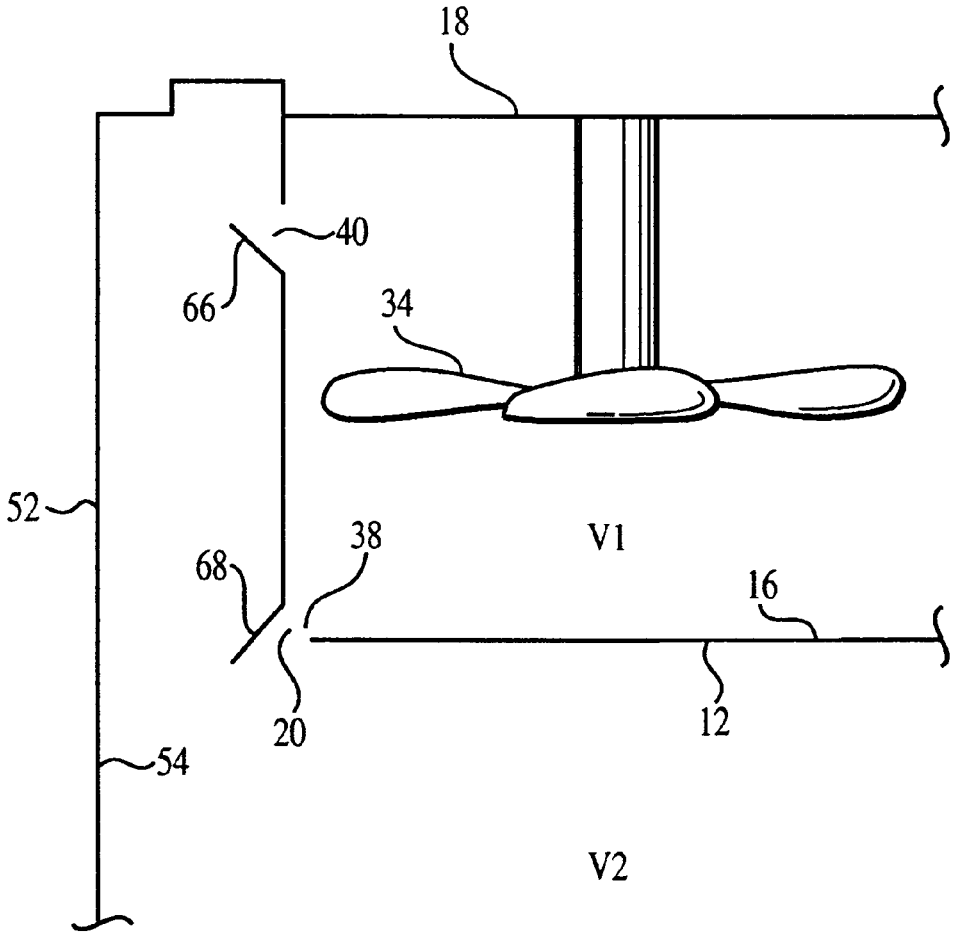
FIG. 8 is a partial sectional view of the two-chamber system depicted in FIG. 2, illustrating the recirculation features of the present invention.

Referring now to FIG. 8, louvers 66 and 68 are respectively located on the recirculation port 40 and the flame jet port 38, and are preferably formed from the same solid, rigid, and combustion-resistant materials as the chamber 12. The louvers 66, 68 are spring-biased to remain open and allow airflow into and out of the chamber 12. Unlike reed valves, the louvers 66, 68 remain normally open, and only close when the pressure on one side of the louver reaches a threshold. Because the louvers 66, 68 are normally open, greater airflow is allowed through the chamber 12 in between combustion events, thereby decreasing the time required to complete the ancillary processes.

During combustion events, however, as pressure rapidly builds in the volume V2, the louvers 66, 68 close when the force of pressure in volume V2 is greater than the louver spring-bias force. The present inventors have discovered, however, that a sufficient pressure in the volume V2 may still be achieved if the recirculation port 40 remains open during combustion, even though the pressure in volume V2 is not as high as would be seen with the use of a reed valve, or the louver 66. Backflow through the port 40, from a gap between the vertical structure 14 and the vertical wall 54, is thus not a significant concern using to the improved configuration of the present invention.

Figure 9:
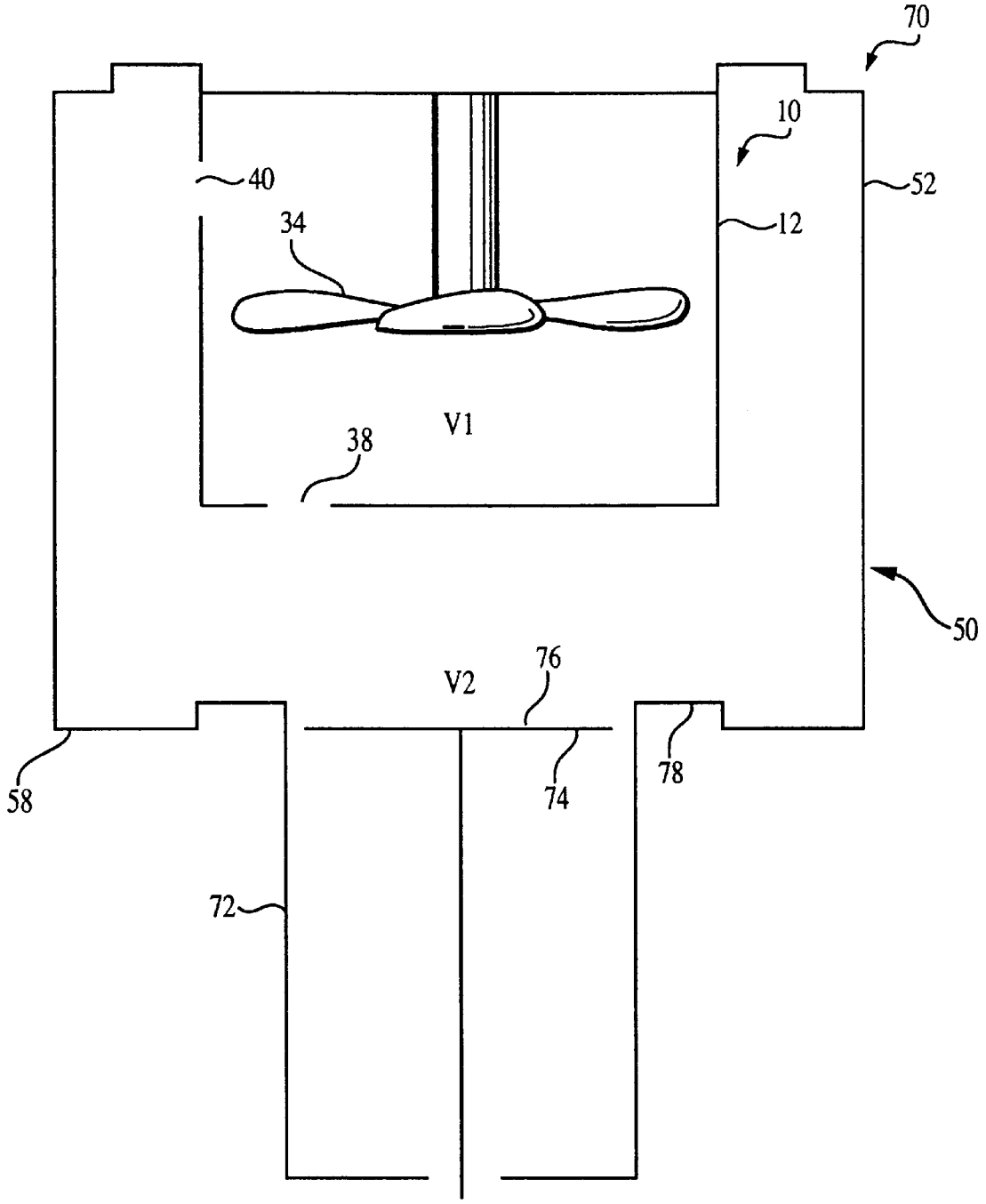
FIG. 9 is a vertical schematic sectional view of a tool employing the two-chamber apparatus of the present invention.

Referring now to FIG. 9, a gas combustion-powered piston tool is generally designated 70, and incorporates the two-chamber apparatus 50 into its configuration. The apparatus 50 contacts a cylinder 72 slidably accommodating a piston 74 through an opening 76 in the lower horizontal wall 58. In a preferred embodiment, the piston 74 and a radically flared end 78 of the piston chamber 72 form a portion of the horizontal wall 58. A rapid increase in combustion pressure in the volume V2 drives the piston 74 down the piston chamber 72 in a direction away from the apparatus 50.

Figure 10:
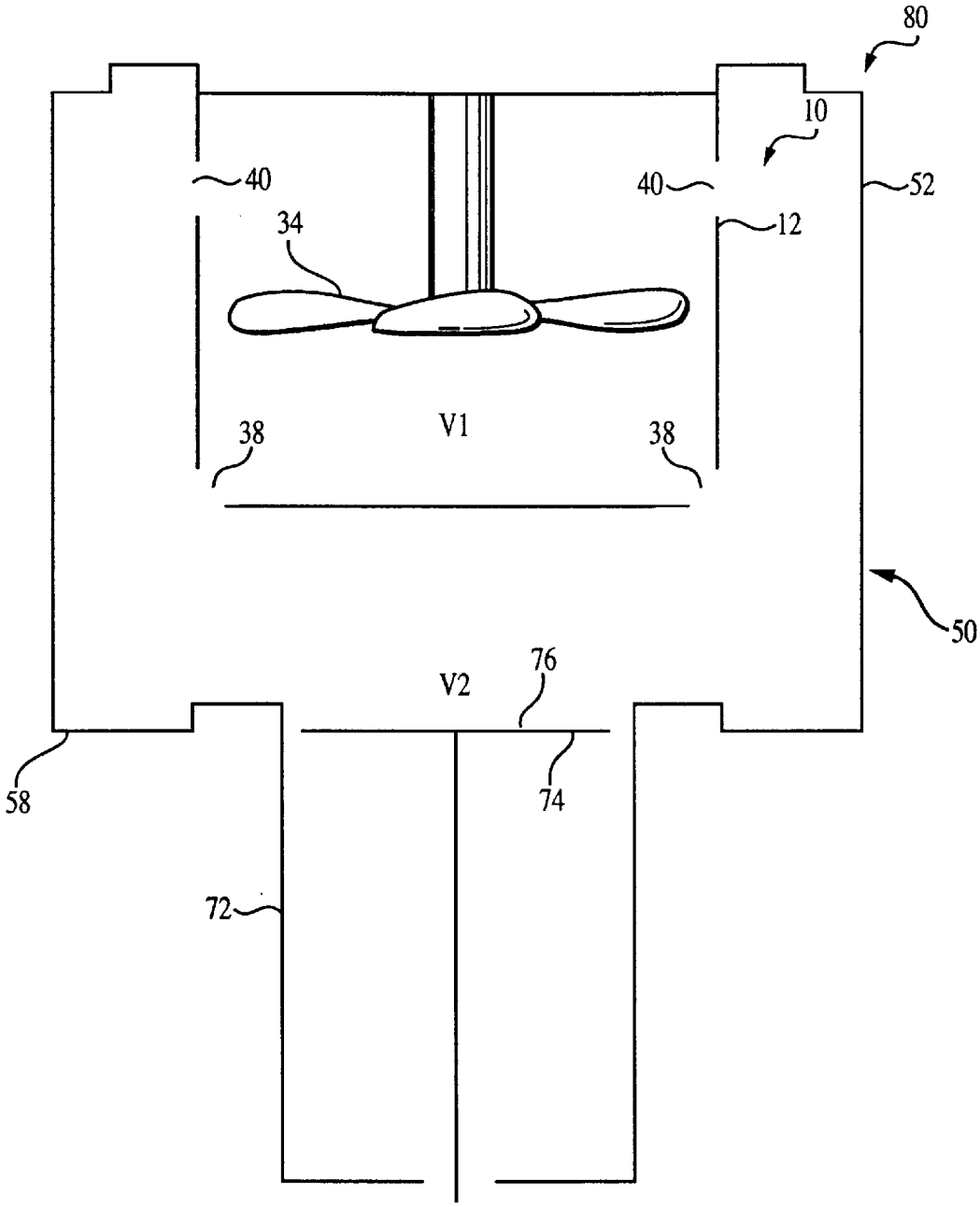
FIG. 10 is a vertical schematic sectional view of another embodiment of the tool depicted in FIG. 9.
Figure 11:
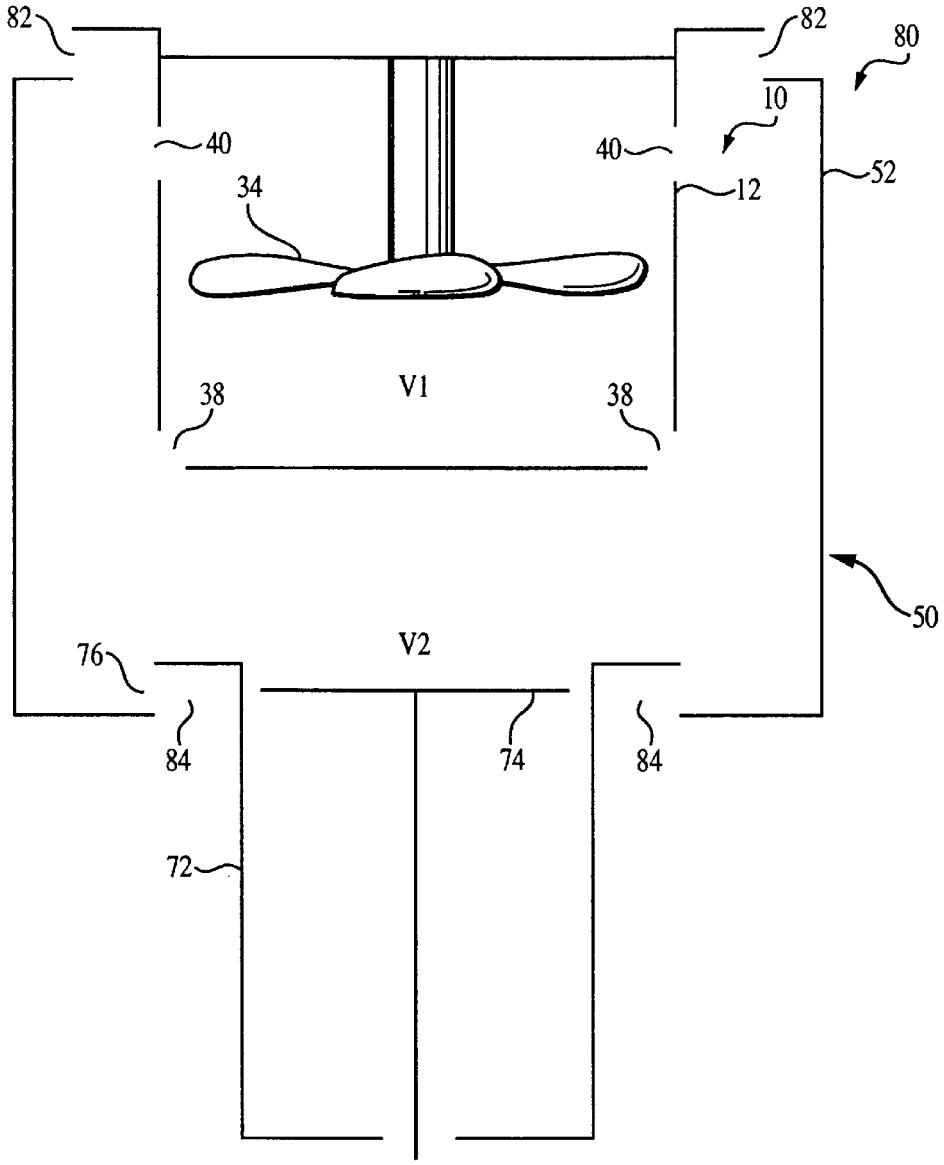
FIG. 11 is a vertical schematic sectional view of the tool depicted in FIG. 10, illustrating the purge features of the present invention.

Referring now to FIGS. 10 and 11, an alternate tool is generally designated 80, and incorporates the apparatus 50, but now employing a plurality of flame jet ports 38 and recirculation ports 40. The additional ports facilitate greater airflow through the combustion chamber 12 and the second chamber 52 during the combustion cycle, as well as during purging, where combustion by-products within the chambers are removed and clean air enters.

FIG. 11 shows the tool 80 in a purging condition, where the second chamber 52 movably disengages from the combustion chamber 12 and the piston chamber 72 to provide first and second openings 82 and 84 respectively in the volume V2. Clean air preferably flows into the volume V2 through the first opening 82, and then into the volume V1 through the recirculation ports 40 Combustion by-products are preferably flushed out of the volume V1 through the flame jet ports 38, and then out of the volume V2 through the second opening 84. After purging, the second chamber 52 movably reengages the combustion chamber 12 and the piston chamber 72 to seal the volume V2 to allow fuel injection for the next combustion cycle.

Figure 12:
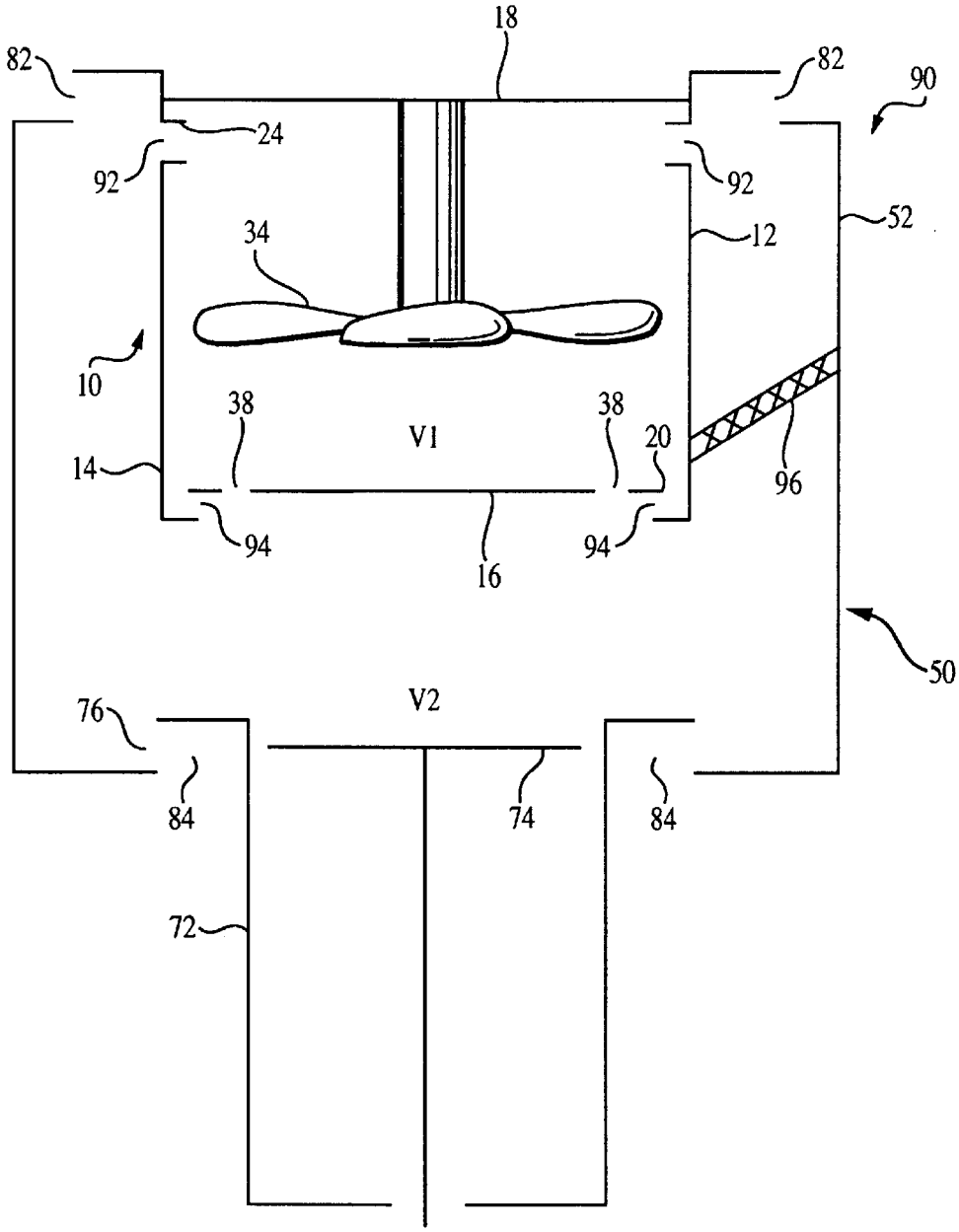
FIG. 12 is a vertical schematic sectional view of another embodiment of the tool depicted in FIG. 11.

Referring now to FIG. 12, a further alternate tool is generally designated 90, and also incorporates the apparatus 50, and the movingly disengaging the second chamber 52 shown in FIG. 11. In this embodiment, however, the vertical structure 14 of the combustion chamber 12 movably disengage from the horizontal structure 18 to form an opening 92 at the joint 24. While disengaged, the opening 92 allows airflow into the combustion chamber to perform the function of the recirculation ports discussed above. In a preferred embodiment, the horizontal structure 16 is fixed, and the vertical structure 14 may also movably disengage from the horizontal structure 16 to form an opening 94 at the joint 20, to allow even greater airflow through the combustion chamber 12 during purging the volumes V1 and V2.

According to this embodiment, chambers 12 and 52 may disengage to open and close together, or independently. The second chamber 52 is preferably joined to the combustion chamber 12 by a retention member 96. The retention member 96 is preferably a combustion-resistant flexible webbing which allows airflow and fuel mixture, but may also be made from any flexible combustion-resistant material known in the art. The retention member 96 may be rigid enough to force chambers 12 and 52 to open and close together, or flexible enough to allow chambers 12 and 52 to move independently. In a preferred embodiment, the second chamber 52 reengages to close the openings 82 and 84 to seal the volume V2 before the vertical structure 14 reengages to close the openings 92 and 94 and seal the volume V1. The volume V1 thus briefly remains open to allow greater fuel movement and mixture between the volumes V1 and V2. The tool 90 should then be fired after the vertical structure 14 reengages to seal the volume V1.

The compact geometry of the apparatus 50, with its improved combustion speed characteristics, avoids the need for a piston delay device in the tool 80. The improved configuration of the present invention also reduces the amount of material required to house the tool 80. The reduced combustion time experienced by the present invention will additionally yield a decrease in heat lost to chamber walls. The negative effects caused by heat loss are even further improved by the action of the fan 34, which additionally cools the internal components of the tool 80. The improved flow and circulation of the apparatus 50 also functions to prevent flooding of the combustion chamber 12 if a user activates the tool 80 without creating a spark in the chamber 12.

Those skilled in the art are apprised that combustion apparatuses, such as in the present invention, may also be effectively employed in other devices which drive a piston, or devices that may be powered by combustion apparatus in general. While particular embodiments of the combustion mechanism of the present invention have been shown and described, it will also be appreciated by those skilled in the art that changes and modifications may be made thereto without departing from the invention in its broader aspects, and as set forth in the following claims.

What is claimed is:

1. A mechanism for generating at least one high-energy flame jet, comprising:

a volume formed of at least one vertical structure and first and second opposing horizontal structures, a majority of respective surface areas of said two opposing horizontal structures being closed;

a rotatable fan in said volume, said fan rotatable in a plane generally parallel to a plane of said horizontal structures;

means for igniting a combustible gas contained within said volume; and the mechanism being configured for propelling the flame jet outside of said volume.

2. The mechanism of claim 1, wherein said vertical structure has a length L, said horizontal structure has a diameter D, and the ratio L/D of said volume is less than 2.

3. The mechanism of claim 1, wherein said first horizontal structure includes at least one flame jet port through which the flame jet is propelled.

4. The mechanism of claim 3, wherein said flame jet port is located downstream of said ignition means and in a direction of a swirl created by a rotation of said fan.

5. The mechanism of claim 3, further comprising a shroud covering an opening of said flame jet port facing into said volume, said shroud having first and second openings and a channel connecting said first and second openings, said first opening covering said flame jet port opening, and said second opening located within said volume away from said flame jet port.

6. The mechanism of claim 3, wherein said at least one vertical structure includes at least one recirculation port.

7. The mechanism of claim 3, wherein said flame jet port includes a supersonic nozzle.

8. The mechanism of claim 4, wherein said flame jet port is located 270 degrees from said ignition means in a vertical plane where said ignition means is located at zero degrees.

9. The mechanism of claim 5, wherein said second opening of said shroud is located 270 degrees from said ignition means in a vertical plane where said ignition means is located at zero degrees.

10. The mechanism of claim 6, wherein said at least one recirculation port is located on said vertical structure so that said fan plane of rotation is disposed between said recirculation port and said first horizontal structure, said ignition means being located on said second horizontal structure.

11. The mechanism of claim 6, further comprising louvers, said louvers disposed on said flame jet port and recirculation port and remaining normally open, but closing when a pressure outside of said volume is greater than a threshold pressure.

12. A gas combustion powered apparatus, comprising:

a substantially closed first chamber defining a first volume therein;

a rotatable fan located in said first chamber;

ignition means located in said first chamber to ignite a combustible gas;

a second chamber defining a second volume therein; and communication means between said first volume and said second volume, said communication means constructed and arranged for enabling passage of an ignited gas jet from said first volume to said second volume.

13. The apparatus of claim 12, wherein a portion of said first chamber is contained within said second chamber.

14. The apparatus of claim 12, wherein said communication means is at least one flame jet port located on a wall of said first chamber.

15. The apparatus of claim 12, wherein said first chamber is a cup-shaped divider having a first end defining an opening and separating said first volume from said second volume, said first opening of said cup-shaped divider substantially closing by contacting an interior wall of said second chamber.

16. The apparatus of claim 12, wherein said first chamber is a cylinder, said cylinder having a length L and a diameter D, and a ration L/D is less than 2.

17. The apparatus of claim 12, further comprising:

an opening in said second chamber;

a piston chamber in communication with said second chamber through said opening in said second chamber; and a piston disposed in said piston chamber, said piston and said piston chamber constructed and arranged for enabling a combustion pressure in said second volume to drive said piston in a direction away from said second chamber.

18. The apparatus of claim 12, wherein said second chamber is constructed and arranged to enable movable disengagement from said first chamber to allow airflow after a combustion event.

19. The apparatus of claim 14, further comprising at least one recirculation port in a wall of said first chamber.

20. The apparatus of claim 14, wherein a speed of said ignited gas jet exiting said flame jet port is equivalent to the speed of sound.

21. The apparatus of claim 14, wherein said flame jet port includes a supersonic nozzle.

22. The apparatus of claim 19, wherein said recirculation port is located between said ignition means and a plane of rotation of said fan.

23. The apparatus of claim 19, further comprising louvers located at said flame jet port and said recirculation port, said louvers remaining normally open, but closing when a pressure in said second volume reaches a threshold pressure.

* * * * *

UNITED STATES PATENT AND TRADEMARK OFFICE

CERTIFICATE OF CORRECTION

PATENT NO. : 6,779,493 B2
DATED : August 24, 2004
INVENTOR(S) : James E. Doherty et al.

It is certified that error appears in the above-identified patent and that said Letters Patent is hereby corrected as shown below:

Title page,
Item [75], Inventors, please add -- Bruno Toulouse --

Signed and Sealed this

Twelfth Day of October, 2004

JON W. DUDAS
*Director of the United States Patent and Trademark Office*